US008239987B2

(12) United States Patent
Sharp

(10) Patent No.: US 8,239,987 B2
(45) Date of Patent: Aug. 14, 2012

(54) HEADREST PILLOW AND EYE MASK ATTACHMENT FOR NECK PILLOW

(76) Inventor: Eric Sharp, Fife, WA (US)

( * ) Notice: Subject to any disclaimer, the term of this patent is extended or adjusted under 35 U.S.C. 154(b) by 0 days.

(21) Appl. No.: 13/301,173

(22) Filed: Nov. 21, 2011

(65) Prior Publication Data

US 2012/0144590 A1 Jun. 14, 2012

Related U.S. Application Data

(60) Provisional application No. 61/422,707, filed on Dec. 14, 2010.

(51) Int. Cl.
*A47G 9/10* (2006.01)

(52) U.S. Cl. ..... 5/639; 5/640; 5/636

(58) Field of Classification Search ..... 5/639, 640, 5/636, 632, 630, 657, 652, 490
See application file for complete search history.

(56) References Cited

U.S. PATENT DOCUMENTS 4,679,263 A 7/1987 Honer
4,688,286 A * 8/1987 Miker, Jr. ..... 5/490
4,914,765 A * 4/1990 Smith ..... 5/639
5,343,561 A 9/1994 Adamo
6,484,337 B1 * 11/2002 Moe et al. ..... 5/652
6,651,256 B1 11/2003 Swift
6,795,990 B1 * 9/2004 Hutchinson D. C. ..... 5/632
7,657,954 B1 * 2/2010 Bunkers ..... 5/644
8,136,186 B1 * 3/2012 Leach ..... 5/631
2012/0144590 A1 * 6/2012 Sharp ..... 5/639

* cited by examiner

*Primary Examiner* — Robert G Santos
(74) *Attorney, Agent, or Firm* — Daniel Boudwin

(57) ABSTRACT

An improved neck cushion device with associated eye mask and headrest cushion for improved comfort while sleeping in an upright position. The device comprises a standard neck pillow having a general C-shape and internal cushioning, attached to an upstanding headrest and deployable eye mask. The headrest secures to the neck pillow via a closed loop, wherein the neck pillow is inserted therethrough. The neck pillow is secured around the neck of a user, while the headrest is positioned between the back of a user's head and a seat to provide upright support. The eye mask is deployable from a pouch along the back of the headrest, and is attached via a band of fabric to prevent its misplacement. The user is provided comfort by properly supporting their head along the neck and behind the head, while the eye mask provides a blind for darkened sleeping.

3 Claims, 2 Drawing Sheets

HEADREST PILLOW AND EYE MASK ATTACHMENT FOR NECK PILLOW

CROSS REFERENCE TO RELATED APPLICATION

This application claims the benefit of U.S. Provisional Application No. 61/422,707 filed on Dec. 14, 2010, entitled "Pillow and Eye Mask."

BACKGROUND OF THE INVENTION

1. Field of the Invention

The present invention relates to the general art of bedding and to the particular field of pillows. More specifically, the present invention relates to a supportive travel pillow combined with an eye mask and headrest support for increased comfort during travel and in otherwise well lit environments.

Relaxing and sleeping while travelling can be difficult. Individuals may have trouble blocking out surrounding sounds and lights, and may struggle to find comfortable positions in vehicle seats and while seated in a near upright position. Further, for business travelers or night travelers, adequate sleep is a requirement for proper rest and operating at a full capacity the following day. To alleviate sleeping problems while traveling, many consumers use eye masks to block out disruptive lights, as well as portable, supportive neck pillows for upper-body comfort. Typical neck pillows a C-shaped cushions that wrap around the sides and back of a user's neck, allowing the user to support their head in an upright fashion while seated upright. This prevent neck cricks and pains due to slouching of the user's head while sleeping in an upright position, and further prevents the user for leaning onto another structure (i.e. the cabin walls or window of a plane). However, neck pillows do not offer adequate support or cushioning for the back portions of user's head, resulting in discomfort and the head resting backwards onto the neck pillow alone with no support from the seat. Compounding the issues related to current neck pillows and traveling environments is the presence of ambient or higher than preferred lighting therein. These environments can prevent some individuals from achieving complete R.E.M. sleep. These individuals often carry eye masks while traveling, which are carried separately from the neck support pillow. This added cargo can be cumbersome and a hassle, and may increase the risk of one or both items becoming misplaced and lost.

An effective solution is necessary to address the issue of a head and neck support, while providing a user with an environment conducive to achieving restful sleep in the confines of a travelling environment, such as on a plane, train or other situation wherein a user is seated in a generally upright position for an extended period of time. The present invention provides a combined headrest, neck pillow and eye mask in one assembly, addressing this need in the art. The head rest is a cushioned pillow that attaches to a standard, C-shaped neck pillow via a loop of material. A pouch along the backside of the headrest pillow provides a storage location for an attached eye mask, which is affixed to the headrest using a strip of fabric to prevent misplacement of eye mask. In use, the user is supported around his or her neck and along the back of his or her head, while the mask is placed over the user's eyes to create a dark environment for improved sleep in otherwise lit environments.

2. Description of the Prior Art

Several patents have issued related to combinations of pillows and eye masks. While these inventions describe similar elements to the present invention, they have several known drawbacks and do not completely address the issues of head and neck support, while providing an eye mask.

Several issued patents describe custom neck pillow and support devices. Honer U.S. Pat. No. 4,679,263 is directed to a pillow carried on a person's head to hold the head in a natural position. The pillow includes a back cushion held against the back of the head, and side cushions held against the sides of the head. The side cushions attach to the back cushion, holding the rear ends together. Straps are fixed to the front of the side cushions to holding the front ends together. A flap is fixed to the back cushion, extending over the top of the head and is fixed to the straps to prevent downward movement of the pillow. The back cushion may have an extension shaped to support the natural shape of the cervical region of the backbone. Similarly, Swift U.S. Pat. No. 6,651,256 is directed to a pillow worn in the manner of a helmet including an inner layer of cotton type material, an outer layer and an intermediate layer of foam. The pillow blocks noise and light from getting to the wearer. The pillow also includes a neck-supporting portion. A stretchable neck-encircling portion permits pulling the pillow over the wearer's head while holding the pillow snugly in place.

The Honer and Swift inventions describe customized sleeping devices for attachment to the neck that may include a means of covering the user's eyes and ears. Both devices are not capable of attachment to a neck pillow, and thus, force the user to forego the ability to incorporate the headrest support and eye mask onto an existing travel neck pillow. The Honer and Swift device are further not adapted for use in public situations, such as in a traveling environment. These devices are more therapeutic head covers that provide eye covering and head cushions for rest in a normal resting position. They are both cumbersome and overly intrusive in a traveling environment. The present invention provides neck and head support, while providing eye coverage. The device functions with a standard neck pillow with no alterations.

Adamo U.S. Pat. No. 5,343,561 is directed to an improved sleeping mask that wraps around the front of a user's head and connects to his or her ears, providing noise baffling and improved darkness for a resting user. For providing noise protection, a holding device is formed that extends into a region adjacent to the wearer's ears and pertains to an eye mask and receiving pockets for the outer ears on the inner side facing the head. A drawstring has one end secured to the eye mask and a free end projecting out of a recess in a lower edge of the eye mask. The drawstring pulls to secure the outer end into a receiving pocket. The Adamo invention describes an eye mask that secures to the ears and fails to address the issues of neck and head support in combination with an eye mask cover, as provided in the present invention.

The aforementioned prior art devices fail to provide for the appropriate combination of head and neck cushioning, combined with an apparatus for shrouding a user's eyes that is easily transported and used in a travel environment. While suited for their intended purposes and fulfilling a need in the art, the prior art devices lack the ability to be utilized with a standard neck pillow, and further do not provide the combined sleep aids necessary for an seated, upright user while traveling. The present invention substantially diverges in design elements from the prior art, and consequently it is clear that there is a need in the art for an improvement to existing neck pillow, headrest pillow and eye cover combination devices. In this regard the instant invention substantially fulfills these needs.

SUMMARY OF THE INVENTION

In view of the foregoing disadvantages inherent in the known types of travel pillow support devices now present in the prior art, the present invention provides a new neck and headrest support pillow combined with an eye shroud attachment wherein the same can be utilized for providing convenience for the user when sleeping or traveling, particularly when seated and in an upright position.

It is therefore an object of the present invention to provide a new and improved travel pillow and eye cover device that has all of the advantages of the prior art and none of the disadvantages.

The present invention describes a headrest pillow and eye mask assembly that is attachable to a standard travel neck pillow. The present invention describes a combination of a travel neck pillow, a headrest pillow having a rear pouch and an eye mask device deployable therefrom. The device serves to provide comfort and darkness while traveling in an upright or prone position. The headrest pillow portion can fold upward to support the back of the head or fold downward to provide an upper back support, whichever is desired in the given situation. The eye mask attaches to the side of the headrest pillow portion for easy access and can be stored in a pouch on the rear side thereof.

The present invention features a portable neck and headrest pillow combination having a complimentary eye mask apparatus. The headrest and eye mask portions are attachable to any existing neck pillow, or may be provided as a complete assembly with a neck pillow. The eye mask is sewn to the headrest cushion to prevent misplacement, while it can be stored in a convenient storage pouch when not desired. Any C-shaped neck pillow may secure through a loop at the base of the headrest pillow, securing the headrest and the associated eye mask to the neck pillow for easy transport and deployment while traveling. Users will enjoy this product while relaxing at home or sleeping in traveling vehicles.

It is therefore an object of the present invention to disclose a combined head and neck pillow having eye covering that provides optimal comfort and relaxation while resting or sleeping, particularly while traveling in a moving vehicle and seated in a generally upright position.

Another object of the present invention is to provide a portable neck and headrest pillow in combination with a storable eye mask, the storable eye mask being retain and deployable from a pouch along the backside of the headrest pillow.

Yet another object of the present invention is to provide a combined head and neck pillow having eye covering capable of attachment to a standard travel neck pillow for additional support and comfort, wherein a closed loop is provided for the neck pillow to insert therethrough.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself, and manner in which it may be made and used, may be better understood by referring to the following description taken in connection with the accompanying drawings.

DETAILED DESCRIPTION OF THE INVENTION

Figure 1:
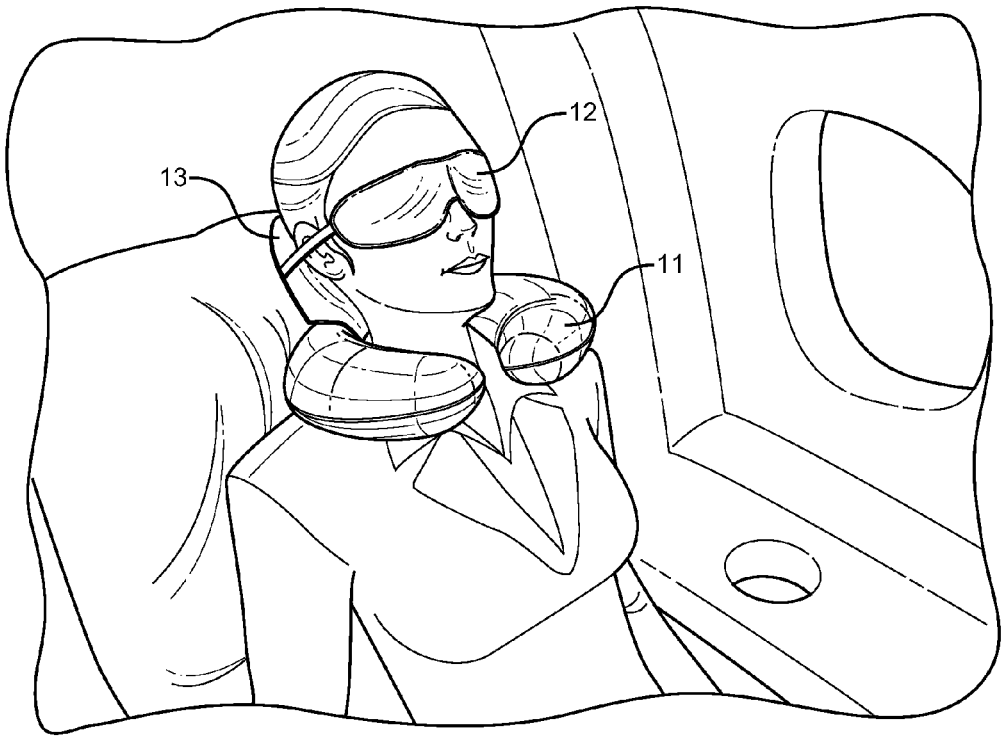
FIG. 1 is a perspective view of the present invention in use, wherein the neck pillow surrounds the user's neck, the headrest pillow is providing support for the back of the user's head and the eye mask is deployed to shroud the user's eyes from light.

Reference is made herein to the attached drawings. Like reference numerals are used throughout the drawings to depict like or similar elements of the combined neck and headrest pillow having a deployable eye cover device. For the purposes of presenting a brief and clear description of the present invention, the preferred embodiment will be discussed as used for providing head and neck support, along with an attached eye covering for a user. The figures are intended for representative purposes only and should not be considered to be limiting in any respect.

Referring now to FIG. 1, there is shown a perspective view of the present invention in use, wherein a seated, upright user is provided head and neck support while shrouding her eyes for increased darkness while resting. The present invention comprises three main components, a C-shaped neck pillow 11, a headrest portion 13 having a neck pillow attachment means and a rear pouch, along with an eye mask 12 deployable from the headrest pouch. It is desired to disclose an improvement to existing travel neck pillows, wherein an assembly attachable to an existing neck pillow may be provided to a user, comprising of the headrest 13 assembly and eye mask 12. It is further desired to disclose an assembly containing all three main components, the neck pillow, headrest pillow and eye mask, which may be provided as a complete set for a user.

The present device is aimed at providing improved head and neck support for a traveling individual, and in particular those individuals traveling in an upright, seated position for extended periods. These conditions introduce the likeliness of a user to fall asleep without adequate head and neck support, which can manifest itself as slouching forward, the user's head rolling to one side or resting against an otherwise uncomfortable support such as an airplane interior wall panel or window. These sleeping postures can lead to neck cricks and muscle aches, and are not conducive to providing adequate sleep conditions that may be required when traveling long distances. Individuals traveling for business are often required to sleep overnight on a plane and be ready to work upon landing. Without adequate sleep, the result can be an individual who cannot function in peak performance when required the following day.

The present invention therefore provides an improvement to existing neck pillows, which currently only prevent the head from rolling to one side and generally do not provide adequate support for the head. This is particularly true if leaning backwards in reclining chair, wherein the neck compresses the neck pillow and as the head is unsupported by the headrest of the seat. The separation between the head of the user and the headrest is created by the thickness of the neck pillow, whereby the head goes unsupported from the rear and can lead to neck pain, defeating the primary goal of the neck pillow and rendering it useless. The present invention therefore provides an attachable headrest pillow 13 that is attachable to a standard travel neck pillow 11, whereby both the back of the head and the neck are supported. This allows the individual to rest in a fully upright posture or in a slightly reclined posture and retain support of the head in a comfortable manner, eliminating neck cricks and uncomfortable bending thereof.

Figure 2:
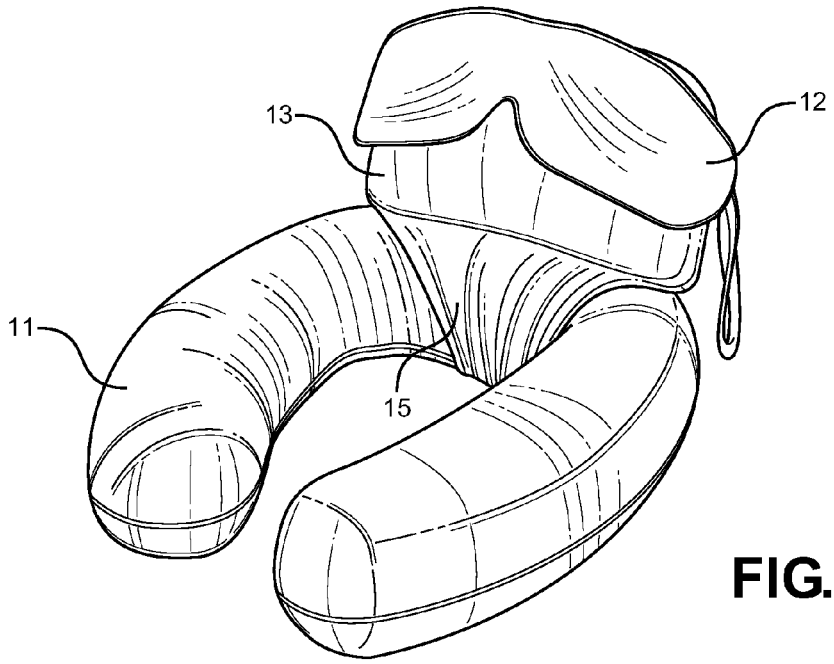
FIG. 2 is a perspective view of the present invention assembly with the attached eye mask deployed.

Referring now to FIG. 2, there is shown a frontal perspective view of the present invention assembly, wherein a C-shaped neck pillow 11 is attached to an upstanding headrest pillow 12. The neck pillow 11 surrounds a user's neck and supports their head from tilting to the side while resting, while the attached headrest pillow 13 provides a pillow to support the back of a user's head. The headrest pillow 13 attaches to the neck pillow 11 using a loop of material 15, whereby the neck pillow 11 may be inserted and secured therethrough. Alternatively, the two may be stitched together. It is preferred to attach the two pillows using a loop 15, since the user may separate the two if necessary, the headrest portion 13 may be utilized with an existing neck pillow 11, or the headrest portion 13 may be rotated around the neck pillow 11 to provide different support or stowage positions. The head rest 13 may be folded into the void of the C-shaped neck pillow 11, or likewise rotated to provide upper back support for a seated user.

Deployable from the headrest pillow 13 is an attached eye mask 12, which connects thereto using a length of fabric to prevent misplacement. The eye mask 12 is utilized as an eye shroud, increasing the perception of darkness for a resting user when placed over his or her eyes.

Figure 3:
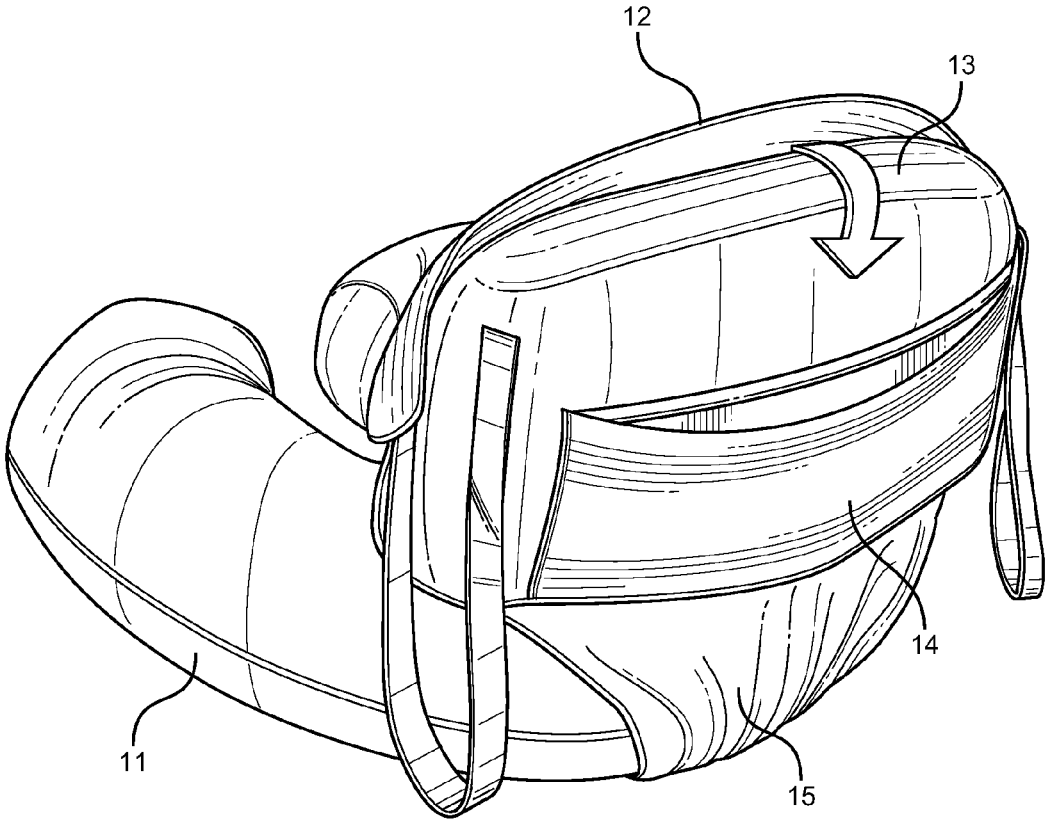
FIG. 3 is a rear perspective view of the present invention assembly, highlighting the rear storage pouch for the eye mask and the connection between the neck pillow and headrest pillow.

Referring now to FIG. 3, there is shown a rearward perspective view of the present invention highlighting the storage pouch 14 for the eye mask 12. The eye mask 12 is deployable from the pouch 14 when desired, and stored therein when not desired by the user. In this way, the mask is both attach to and stored with the headrest 13 at all times. The neck pillow 11 and headrest pillow 13 covering may be made of any comfortable material contemplated by one skilled in the art of pillows, including cotton, velvet or any other material suitable for providing tactile comfort and a durable covering for the cushioning material within the pillows. The connecting loop 15 between the headrest 13 and the neck pillow 11 may be a continuation of the same fabric, or an alternative fabric if so desired.

Overall, the present invention is a device for achieving comfortable support in otherwise uncomfortable sleeping positions, and blocks out disruptive light while relaxing or sleeping, particularly while traveling. The device comprises a traditional portable neck pillow 11 and a removable eye mask apparatus 12. The eye mask apparatus 12 attaches to the head cushion component 13 to prevent loss and allow for easy location. Further, the head cushion component 12 is equipped with a pouch 14 to store the eye mask apparatus. The eye mask apparatus 12 may attach to the sides of the head cushion component 13, and may be folded back and placed into the pouch 14 when not in use. The eye mask apparatus 12 may be positioned over the user's eyes when needed for assistance sleeping. An attachable fabric loop 15 at the base of the head cushion component 13 hangs below and allows the head cushion 13 and attached eye mask apparatus 12 to fit securely over the provided neck pillow 11. Alternatively, at the user's preference, the device can be fit over any other existing neck pillow as desired 11. Further, the device may have removable padding, to allow the fabric covering to be removed and washed in a standard washer and dryer. In this embodiment, a zipper closure or similar closure means may provide access to the inner padding and allow removal of the outer fabric.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pillow device for supporting the neck and head of an individual, comprising:

a headrest pillow;

an eye mask;

a closed loop of fabric secured to said headrest pillow for removably securing said headrest pillow to a C-shaped neck pillow such that a lower surface of said headrest pillow snuggly abuts an upper surface of said C-shaped neck pillow when deployed.

2. The device of claim 1, wherein said eye mask is attached to said headrest pillow to prevent misplacement thereof.

3. The device of claim 1, wherein said headrest pillow further comprises a rearward pouch, said eye mask adapted to fit into said pouch for storage thereof.

* * * * *